US006560929B1

(12) United States Patent
Staser et al.

(10) Patent No.: US 6,560,929 B1
(45) Date of Patent: May 13, 2003

(54) RACK AND PINION WINDOW REGULATOR

(75) Inventors: Brian H. Staser, Rochester Hills, MI (US); Geoffrey Barr, Troy, MI (US); Brian A. Barnes, Utica, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/068,113

(22) Filed: Feb. 5, 2002

(51) Int. Cl.[7] ..... E05F 11/34
(52) U.S. Cl. ..... 49/362; 49/349
(58) Field of Search ..... 49/360, 362, 358, 49/348, 349

(56) References Cited

U.S. PATENT DOCUMENTS

| | | | | |
|---|---|---|---|---|
| 1,640,864 A | | 8/1927 | Ungerman | |
| 1,937,662 A | | 12/1933 | Nicholson | |
| 2,115,632 A | | 4/1938 | Hanley | |
| 2,336,530 A | | 12/1943 | Chandler et al. | |
| 4,788,795 A | * | 12/1988 | Pinsoneault | 49/352 |
| 4,967,510 A | * | 11/1990 | Torii et al. | 49/358 |
| 4,991,348 A | * | 2/1991 | Yamamura et al. | 49/349 |
| 5,537,782 A | * | 7/1996 | Klippert et al. | 49/358 |
| 5,806,244 A | * | 9/1998 | Tilli | 49/358 |
| 6,035,579 A | | 3/2000 | Staser et al. | |
| 6,073,395 A | * | 6/2000 | Fenelon | 49/358 |
| 6,430,874 B1 | * | 8/2002 | Korte | 49/358 |

FOREIGN PATENT DOCUMENTS

| | | |
|---|---|---|
| CH | 162012 | 5/1933 |
| FR | 624701 | 7/1927 |

* cited by examiner

*Primary Examiner*—Jerry Redman
(74) *Attorney, Agent, or Firm*—Kathryn A. Marra

(57) ABSTRACT

A door for an automotive vehicle has an inner metal stamping and an outer metal stamping that are secured together along a perimeter to form a shell that includes an upper window frame and a lower hollow body and a window regulator that is part of a window module that is assembled to the shell. The window module includes a structural belt beam, a drive assembly, a rack, a window pane and a window guide channel. The window guide channel has a front run, a header and a rear run, the window guide channel being attached to structural belt beam so that the front run is attached to a forward end of the belt beam and the rear run is attached to a rearward end of the belt beam. The window pane has a front edge that travels in the front run and a rear edge that travels in the rear run. The rack is disposed in the rear run and attached to the rear edge of the window pane. The drive assembly is mounted in a rearward end portion of the structural belt beam by a bracket that supports a reversible electric motor. A pinion gear that is secured to an output shaft of the reversible electric motor meshes with the rack so that the window pane is raised and lowered by the reversible electric motor. The rack is made of a glass reinforced plastic and the pinion gear is made of a plastic coated powered metal to reduce noise and friction.

15 Claims, 3 Drawing Sheets

RACK AND PINION WINDOW REGULATOR

FIELD OF INVENTION

This invention relates generally to automotive vehicle doors that are equipped with a moveable window pane of glass and more particularly to a window regulator for raising and lowering the window pane.

BACKGROUND OF THE INVENTION

It is well known in automotive vehicles to mount a window pane of glass in the vehicle door for movement between open and closed positions. The position of the window pane is controlled by a window regulator which commonly includes a lift arm having a lower end pivotally mounted on the door panel. An upper end of the lift arm carries a roller that is mounted in a sash panel that is attached to the bottom of the window pane. As the lift arm is rotated, the window glass is raised and lowered. Lift arm window regulators typically include a relatively large sector gear that is carried by the lift arm. A crank shaft operated by either a manual crank handle or an electric motor drives a pinion gear that meshes with the sector gear. Rotation of the crank shaft rotates the pinion gear which in turn rotates the sector gear to rotate the lift arm and raise or lower the window pane.

In some circumstances, it is difficult to package a lift arm window regulator because the sector gear carried by the lift arm is relatively large and the crank shaft must be located where the pinion gear meshes with the sector gear.

It is known to use a rack bar in a window regulator mechanism. For instance, U.S. Pat. No. 1,937,662 granted to Stanley W. Nicholson Dec. 5, 1933 discloses a window regulator for a pullman car in which rack bars 38 and 40 are attached to window sashes 17' and 17 respectively. Rack bars 38 and 40 are located between window sashes 17' and 17 with a window regulator R disposed between the rack bars 38 and 40. Window regulator R has a handle 33 that selectively rotates gears 27 and 29 that engage rack bars 38 and 40 respectively to raise and lower window panes 13 and 14. Handle 33 shifts axially to select which gear is rotated.

In one position handle 33 rotates gear 35 which meshes with and rotates gear 30. Gear 30 drives gear 29 via a spring clutch 57 to raise or lower window pane 14. When handle 33 is shifted to another position, gear 35 which is attached to handle 33 meshes with and rotates gear 32. Gear 32 then drives gear 27 via a second spring clutch 57 to raise or lower window pane 13.

The Nicholson window regulator is complicated mechanically, requires considerable space and is not suitable for an automotive application.

U.S. Pat. No. 2,115,632 granted to J. H. Hanley Apr. 26, 1938 discloses a device for raising and lowering automobile window glass 3 comprising a rack bar 5 that is attached to window frame 4. Rack bar 5 is raised and lowered by a five bar linkage comprising links 17, 18, 14,15 and 10. Upper input link 17 is rotated by a handle 16 and lower output link 10 terminates in a sector gear 9 that drives a compound gear 11/13 that meshes with the rack bar 5. Handle 16 is rotated about 90° to lower window 3.

The Hanley window regulator is complicated mechanically and still requires considerable space.

U.S. Pat. No. 2,336,530 granted to Daniel L. Chandler et al Dec. 14, 1943 discloses a floating drive mechanism for raising and lowering an automobile window comprising longitudinally spaced vertical rack bars 36 and 37 attached to the door and a cooperating drive mechanism that is attached to the window sash 15. The drive mechanism comprises an electric motor 24 that drives worm gears 26 and 27 that is turn drive pinion gears 32 and 33 that mesh with rack bars 36 and 37 respectively. The Chandler window regulator is also complicated mechanically and requires considerable space.

It is also known to use a rack that is pivotally attached to the lift arm rather then a fixed sector gear to rotate the lift arm. See for instance U.S. Pat. No. 1,640,864 granted to Carl Ungerman Aug. 30, 1927 and U.S. Pat. No. 6,035,579 granted to Brian H. Staser et al on Mar. 14, 2000. These known rack and pinion window regulators offer some packaging advantages particularly in terms of locating the crank shaft. However, these known rack and pinion window regulators still take up a considerable amount of space in the hollow shell of the vehicle door.

This need for considerable space is becoming a problem as more and more components, such as speakers, power door locks, handle operating linkages, wiring harnesses, etc. are packaged in the door shell. Accordingly, there is a need for a compact window regulator that takes up very little space in the door shell.

SUMMARY OF THE INVENTION

The invention provides a rack and pinion window regulator for a door for an automotive vehicle that takes up very little space in the door shell. The door has an inner metal stamping and an outer metal stamping that are secured together along a perimeter to form a shell that includes an upper window frame and a lower hollow body. The window regulator is preferably part of a module that includes a structural belt beam of the door. The window regulator also includes a drive assembly, a rack, a window pane and a window guide channel which are also preferably part of the module. The window guide channel has a rear run and optional header and front runs, the window guide channel being attached to structural belt beam so that the front run is attached to a forward end of the belt beam and the rear run is attached to a rearward end of the belt beam. The window pane has a front edge that travels in the front run and a rear edge that travels in the rear run. The rack is disposed in the rear run and attached to the rear edge of the window pane. The drive assembly which is preferably mounted in a rearward end portion of the structural belt beam by a bracket supports a reversible electric motor. A pinion gear that is secured to an output shaft of the reversible electric motor meshes with the rack so that the window pane is raised and lowered by the reversible electric motor. The rack is preferably made of a Teflon impregnated composite material and the pinion gear is preferably made of a Teflon coated powdered metal to reduce noise and friction. Teflon is the tradename of E. I. du Pont de Nemours Co., Inc. for polytetrafluoroethylene.

DETAILED DESCRIPTION OF A PREFERRED EMBODIMENT

Figure 1:
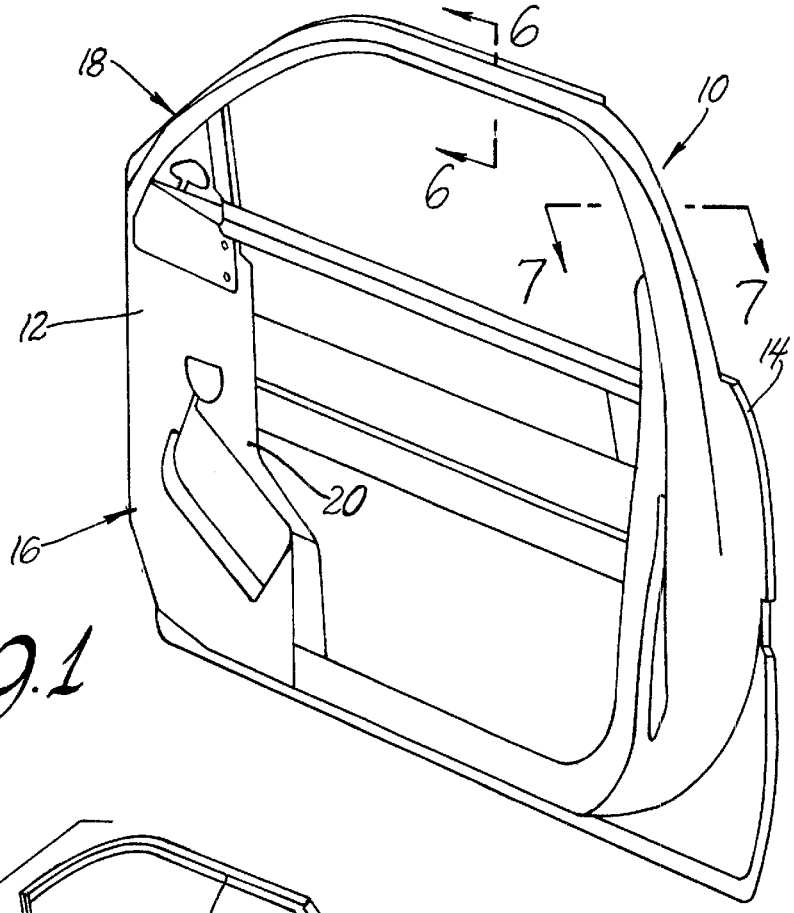
FIG. 1 is perspective view of an automotive vehicle door equipped with a rack and pinion window regulator of the invention.

FIG. 1 shows a right hand or passenger side front door 10 for an automotive vehicle (not shown). Door 10 comprises an inner metal stamping 12 and an outer metal stamping 14 that are secured together along a perimeter to form a shell 16 that includes an upper window frame 18 and a lower hollow body 20 that forms a chamber for door components such as door latches, speakers, handle operating linkages and wiring harnesses.

Figure 3:
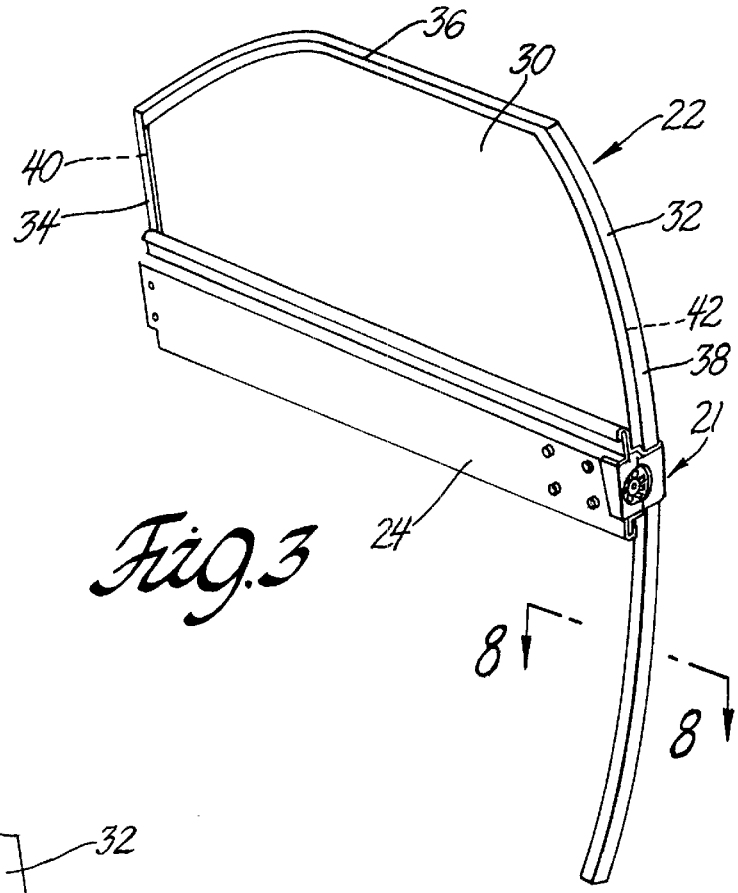
FIG. 3 is a perspective view of a component shown in FIG. 2.
Figure 4:
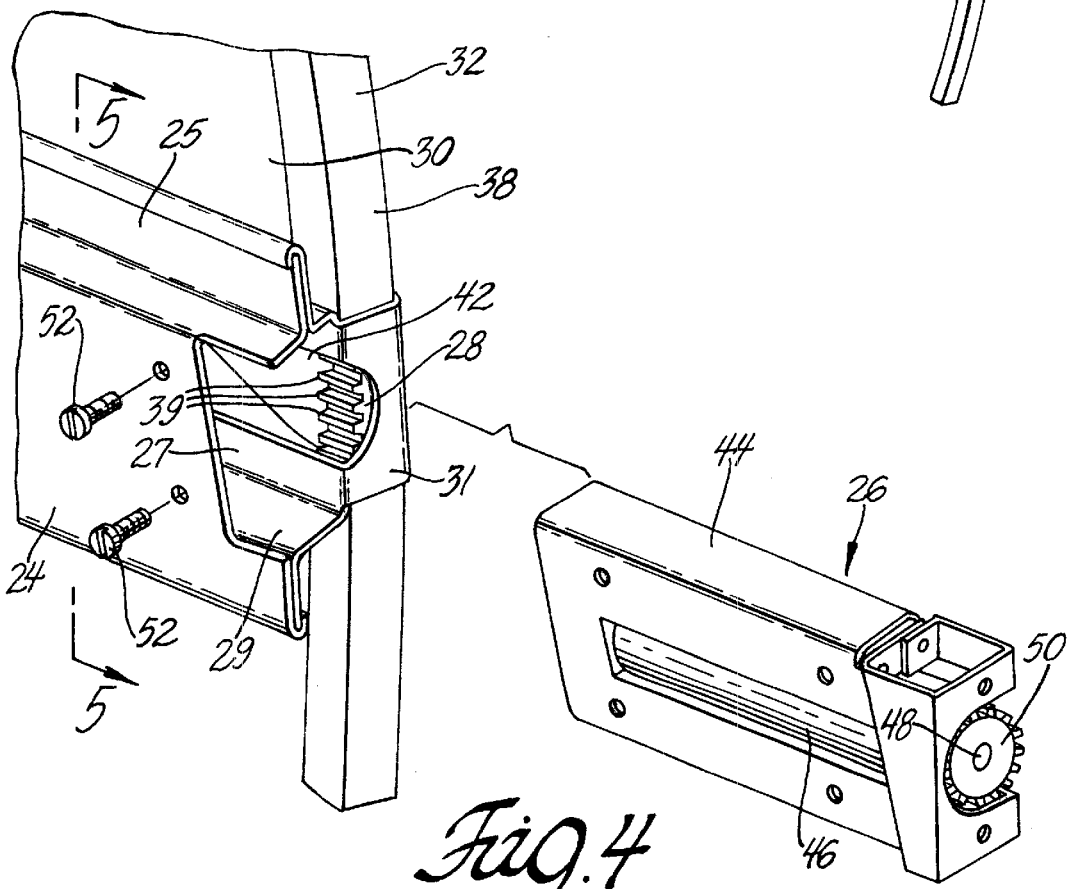
FIG. 4 is a partial exploded view of the component that is shown in FIG. 3.
Figure 5:
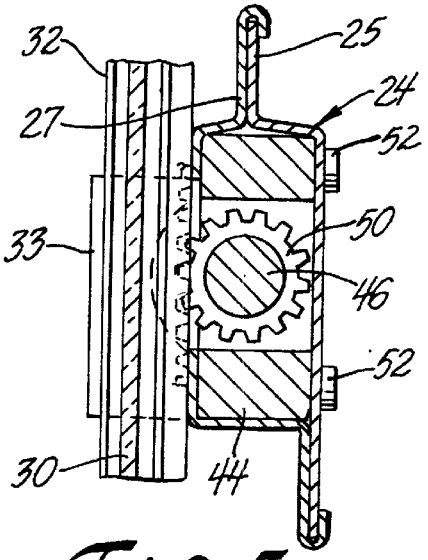
FIG. 5 is a section taken substantially along the line 5—5 of FIG. 4 looking in the direction of the arrows.

Door 10 also includes a window regulator 21 that is preferably part of module 22 that is assembled to shell 16. Module 22 comprises a belt beam 24, a drive assembly 26, a rack 28, a window pane 30 of glass and a window guide channel 32 as best shown in FIGS. 3 and 4. Belt beam 24 is a structural member that extends the length of door 10 at the belt line. The structural belt beam 24 comprises metal members, preferably rolled steel sections, 25 and 27 that are fastened together to form a linear channel 29 as best shown in FIGS. 4 and 5. The opposite ends of structural belt beam 24 are attached to inner metal stamping 12 in any suitable manner.

Window guide channel 32 comprises a front run 34, a header 36 and a rear run 38 as best shown in FIGS. 3 and 4. Rear run channel 34 is essential. However, front run and header channels 34 and 36 are optional and in some instances preferable depending upon the sheet metal structure of door 10. Window guide channel 32 is attached to structural belt beam 24 in any suitable manner, such as by welding, so that optional front run 34, if any, is attached to the forward end of belt beam 24 and rear run 38 is attached to the rearward end of belt beam 24. Window pane 30 has a front edge 40 that travels in front run 34, a rear edge 42 that travels in rear run 38 and a top edge that is stored in header 36 when window pane 30 is raised fully. Rack 28 is disposed in rear run 38 and attached to the rear edge 42 of window pane 30 in any suitable manner, such as by bonding. Rack 28 is attached so that its teeth 39 face inwardly as best shown in FIGS. 4, 5, 7 and 8.

Window pane 30 is raised and lowered by drive assembly 26 which is located in the rearward end portion of structural belt beam 24. Drive assembly 26 comprises a bracket or housing 44 that fits in the linear rearward channel 29 formed by rolled sections 25 and 27 of belt beam 24. Housing 44 preferably supports a reversible electric motor 46 in a longitudinal orientation so that output shaft 48 is substantially parallel to the linear channel 29 of structural belt beam 24 to minimize beam height. Output shaft 48 has a pinion gear 50 secured to it. Housing 44 is mounted in the end portion of structural belt beam 24 and secured by a plurality of machine screws 52 so that pinion gear 50 extends through slots in rolled section 27 and rear run 38 and meshes with rack 28 as best shown in FIGS. 4 and 5. Rolled section 27 includes a flange 31 with a lip 33 for reinforcing the slotted portion of rear run 38. The reversible electric motor 46 is electrically connected to an electrical circuit (not shown) that includes a power source, such as the vehicle battery, and one or more control switches for operating the reversible electric motor 46.

Figure 2:
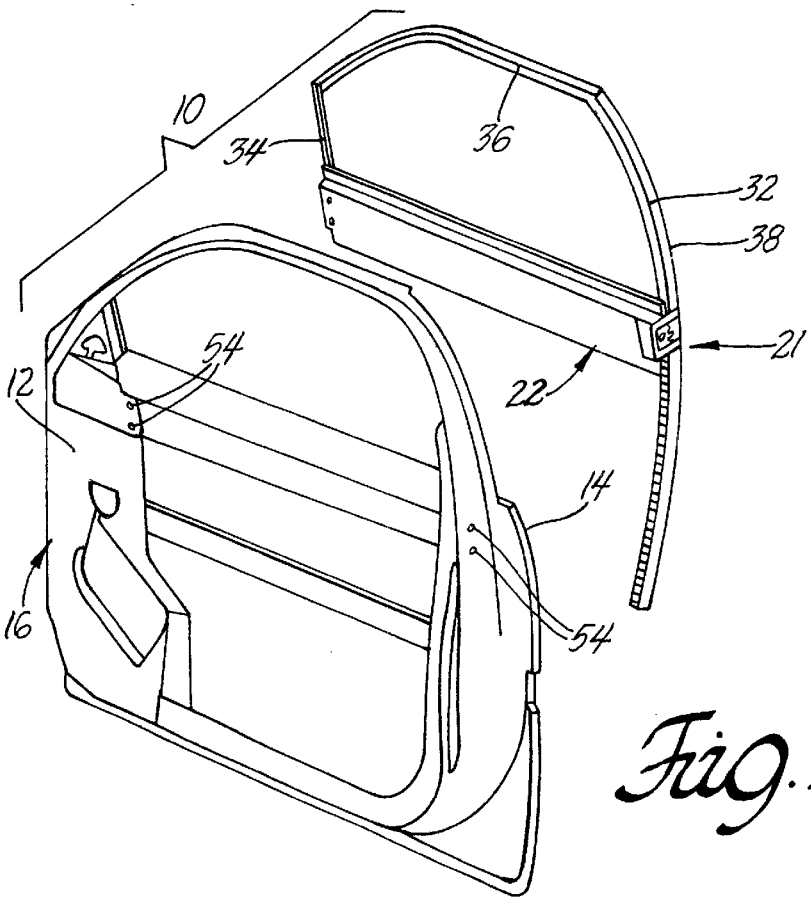
FIG. 2 is an exploded view of the automotive vehicle door shown in FIG. 1.

Window module 22 is loaded into the door shell 16 and fastened in place in any suitable manner, for instance by two bolts through the latch face of door shell 16 and two bolts through the inner metal stamping as shown schematically at 54 in FIG. 2. Window module 22 preferably includes other automotive door components (not shown) such as a handle latching system and a wiring harness or harnesses for operating the drive assembly 26 and the handle latching system if power operated.

Figure 7:
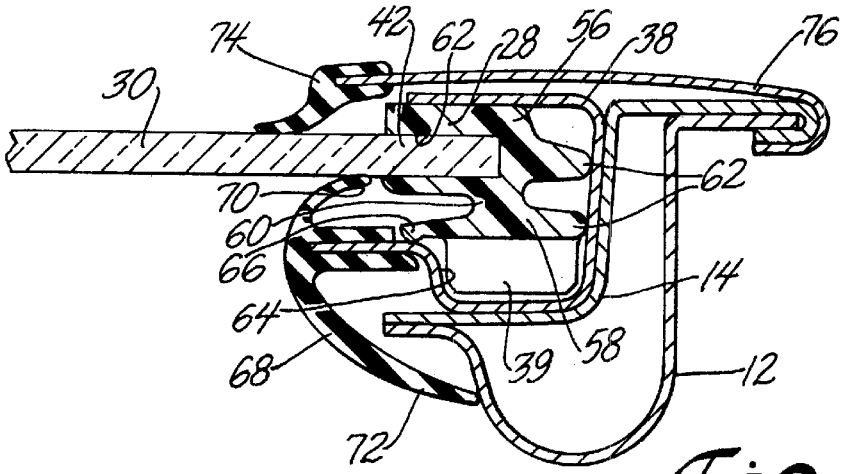
FIG. 7 is a section taken substantially along the line 7—7 of FIG. 1 looking in the direction of the arrows.

The rack 28 is preferably attached to window pane 30 by bonding as best shown in FIG. 7 which also shows the preferred shapes of rack 28 and guide channel 32 particularly the rear run 38 of guide channel 32. Rack 28 preferably has an attachment portion 56 and a rack portion 58 that is attached to the attachment portion 56 by a web 60. Attachment portion 56 includes a slot 62 that receives the rear edge 42 of window pane 30 that is bonded to rack 28. Rack portion 58 includes teeth 39 that are driven by gear 50 to raise and lower window pane 30. The width of web 60 is such that web 60 is strong enough to transfer forces from rack portion 58 to attachment portion 56 in order to raise and lower window pane 30 yet flexible enough to allow a small angular adjustment of rack portion 58 with respect to attachment portion 56 to maintain good contact with gear 50. Attachment portion 56 and rack portion 58 each have a rounded fin 62 that engages the bottom of rear run channel 38 to guide rack 28 along the channel as window pane 30 is raised and lowered. The inward side of rear run channel 38 is depressed at the free end to provide an internal shoulder 64 that confronts the ends of rack teeth 39 to retain rack 28 in rear run channel 38. Rack portion 58 also preferably includes a resilient lip 66 that engages the depressed end of rear run channel 38 with a slight bias to eliminate any play between rack 28 and rear run channel 38 in the lateral direction that would produce rattling and noise.

FIG. 7 also shows a typical sealing arrangement for window pane 30 which includes a dual lip inner seal 68 that is attached to the inner free end of rear run channel 38. Dual inner lip seal 68 has a first resilient seal lip 70 biased against the inner surface of window pane 30 and a resilient second seal lip 72 biased against inner metal stamping 12 of door shell 16. The sealing arrangement also includes a outer seal 74 on an outer trim strip 76 that has a resilient seal lip biased against the outer surface of window pane 30.

Figure 6:
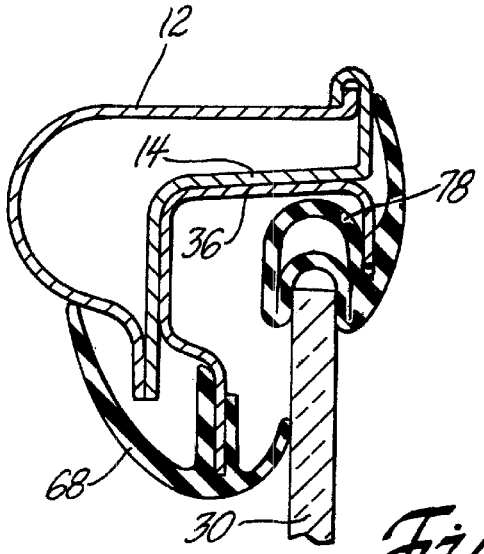
FIG. 6 is a section taken substantially along the line 6—6 of FIG. 1 looking in the direction of the arrows.

FIG. 6 shows the sealing arrangement in the optional header channel 36. In the case of the header channel 36, an internal resilient seal 78 for engaging the top of the window pane 30 in the full up position is provided as shown.

Figure 8:
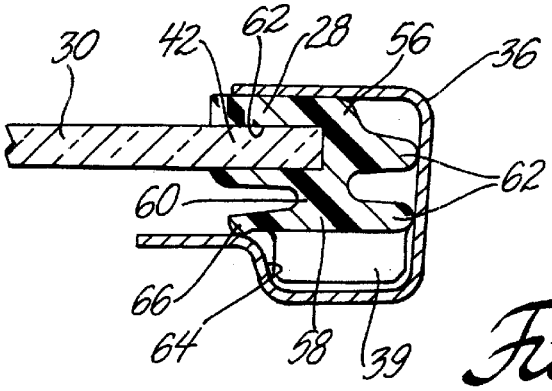
FIG. 8 is a section taken substantially along the line 8—8 of FIG. 3 looking in the direction of the arrows when the window pane is down.

FIG. 8 shows the position of the rack 28 in the rear run guide channel 38 below the belt beam 24 when the window pane 30 is down or retracted within the hollow door shell 16. Of course, it is not necessary to provide any sealing arrangement in this location and none is shown.

Rack 28 is preferably made of a Teflon impregnated composite material, such as a glass reinforced plastic and pinion gear 50 is preferably made of a Teflon coated powdered metal to reduce noise and friction.

Although a preferred embodiment of the present invention has been disclosed, various changes and modifications may be made thereto by one skilled in the art without departing from the scope and spirit of the invention as set forth in the appended claims. It is also understood that the terms used herein are merely descriptive, rather than limiting, and that various changes may be made without departing from the scope and spirit of the invention.

We claim:

1. A rack and pinion window regulator for a door of an automotive vehicle having an inner metal stamping and an outer metal stamping that are secured together along a perimeter to form a shell that includes an upper window frame and a lower hollow body and a window module that is assembled to the shell, the rack and pinion window regulator being part of the window module comprising:

a structural belt beam, a drive assembly, a rack, a window pane and a window guide channel, the window guide channel having a rear run that is attached to a rearward end of the structural belt beam, the window pane having a rear edge that travels in the rear run, the rack being disposed in the rear run and attached to the rear edge of the window pane, and the drive assembly being located in a rearward end portion of the structural belt beam and including a bracket that supports a reversible electric motor which has a pinion gear that is secured to an output shaft of the reversible electric motor and that meshes with the rack so that the window pane is raised and lowered by the reversible electric motor.

2. The rack and pinion window regulator as defined in claim 1 wherein the rack is made of a glass reinforced plastic and the pinion gear is made of a plastic coated powdered metal to reduce noise.

3. The rack and pinion window regulator as defined in claim 1 wherein the rack has an attachment portion and a rack portion that is attached to the attachment portion by a web.

4. The rack and pinion window regulator as defined in claim 3 wherein the attachment portion and the rack portion each have a rounded fin that engages the channel.

5. The rack and pinion window regulator as defined in claim 1 wherein the rear run has an inward side that has a depressed free end to retain the rack in the rear run.

6. The rack and pinion window regulator as defined in claim 5 wherein the rack has a resilient lip that engages the depressed free end of the rear run to reduce rattling and noise.

7. The rack and pinion window regulator as defined in claim 1 wherein the window guide channel includes a front run and a header.

8. A rack and pinion window regulator for a door of an automotive vehicle having an inner metal stamping and an outer metal stamping that are secured together along a perimeter to form a shell that includes an upper window frame and a lower hollow body and a window module that is assembled to shell, the rack and pinion regulator being part of the window module comprising:

a structural belt beam, a drive assembly, a rack, a window pane and a window guide channel, the structural belt beam including a linear channel, the window guide channel having a rear run, that is attached to a rearward end of the structural belt beam, the window pane having a rear edge that travels in the rear run, the rack being disposed in the rear run and attached to the rear edge of the window pane, the drive assembly being located in a rearward end portion of the structural belt beam and including a bracket that fits in the linear channel and supports a reversible electric motor longitudinally in the linear channel, the reversible electric motor having an output shaft that is substantially parallel to the linear channel, and the drive assembly including a pinion gear that is secured to the output shaft of the reversible electric motor and that meshes with the rack so that the window pane is raised and lowered by the reversible electric motor.

9. The rack and pinion window regulator as defined in claim 8 wherein the structural belt beam comprises first and second metal extrusions that are secured together to form the linear channel.

10. The rack and pinion window regulator as defined in claim 9 wherein the rack is made of glass reinforced plastic and the pinion gear is made of a plastic coated powdered metal to reduce noise.

11. The rack and pinion window regulator as defined in claim 9 wherein the rack has an attachment portion and a rack portion that is attached to the attachment portion by a web.

12. The rack and pinion window regulator as defined in claim 11 wherein the attachment portion and the rack portion each have a rounded fin that engages the channel.

13. The rack and pinion window regulator as defined in claim 9 wherein the rear run has a inward side that has a depressed free end to retain the rack in the rear run.

14. The rack and pinion window regulator as defined in claim 13 wherein the rack has a resilient lip that engages the depressed free end of the rear run to reduce rattling and noise.

15. The rack and pinion window regulator as defined in claim 9 wherein the window guide channel includes a front run and a header.

* * * * *